US009347663B2

(12) United States Patent
Poyyapakkam et al.

(10) Patent No.: US 9,347,663 B2
(45) Date of Patent: May 24, 2016

(54) SWIRLER HAVING VANES PROVIDED WITH AT LEAST TWO LOBES IN OPPOSITE TRANSVERSE DIRECTIONS WITH REFERENCE TO A VANE CENTRAL PLANE

(75) Inventors: Madhavan Narasimhan Poyyapakkam, Rotkreuz (CH); Fernando Biagioli, Fislisbach (CH); Khawar Syed, Oberrohrdorf (CH); Ronghai Mao, Windisch (CH); Stefano Bernero, Oberrohrdorf (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 884 days.

(21) Appl. No.: 13/470,109

(22) Filed: May 11, 2012

(65) Prior Publication Data

US 2012/0285173 A1 Nov. 15, 2012

(30) Foreign Application Priority Data

May 11, 2011 (CH) ..... 794/11

(51) Int. Cl.
*F23R 3/14* (2006.01)
*F23C 7/00* (2006.01)

(52) U.S. Cl.
CPC . *F23C 7/004* (2013.01); *F23R 3/14* (2013.01); *F23D 2900/14004* (2013.01); *F23D 2900/14021* (2013.01); *Y10T 137/2087* (2015.04)

(58) Field of Classification Search
CPC ..... F23R 3/14; F23R 3/286; F23C 7/004; F23D 2900/14021; F23D 2900/14004
USPC ..... 60/748, 737; 239/399
See application file for complete search history.

(56) References Cited

U.S. PATENT DOCUMENTS 3,100,627 A * 8/1963 Wilde ..... 366/262
3,620,012 A * 11/1971 Wilde ..... 60/804

(Continued)

FOREIGN PATENT DOCUMENTS

EP 0 321 379 A2 6/1989
EP 0 793 010 A1 9/1997

(Continued)

OTHER PUBLICATIONS

Office Action issued on Jul. 3, 2014, by the Russian Patent Office in corresponding Russian Patent Application No. 2012119216 and an English translation of the Office Action. (12 pages).

(Continued)

*Primary Examiner* — William H Rodriguez
(74) *Attorney, Agent, or Firm* — Buchanan Ingersoll & Rooney PC

(57) ABSTRACT

A swirler including an annular housing with limiting walls. At least two vanes are arranged in the annular housing including the sidewalls of the swirler. The leading edge area of each vane has a profile, which is oriented parallel to a main flow direction prevailing at the leading edge position, wherein the profiles of the vanes turn from the main flow direction prevailing at the leading edge position to impose a swirl on the flow, and wherein, with reference to a central plane of the vanes the trailing edges are provided with at least two lobes in opposite transverse directions. A burner for a combustion chamber of a gas turbine including such a swirler and at least one nozzle having its outlet orifice at or in a trailing edge of the vane and to a method of operation of such a burner.

5 Claims, 6 Drawing Sheets

(56) References Cited

U.S. PATENT DOCUMENTS

| | | | | |
|---|---|---|---|---|
| 4,401,269 | A | 8/1983 | Eiler | |
| 4,786,016 | A | 11/1988 | Presz, Jr. et al. | |
| 4,830,315 | A | 5/1989 | Presz, Jr. et al. | |
| 4,932,861 | A | 6/1990 | Keller et al. | |
| 5,431,018 | A | 7/1995 | Keller | |
| 5,626,017 | A | 5/1997 | Sattelmayer | |
| 5,647,200 | A | 7/1997 | Althaus | |
| 5,941,064 | A | 8/1999 | Chevalier et al. | |
| 6,189,320 | B1 | 2/2001 | Poeschl et al. | |
| 6,733,240 | B2 | 5/2004 | Gliebe | |
| 8,402,768 | B2 * | 3/2013 | Syed et al. | 60/791 |
| 8,528,337 | B2 * | 9/2013 | Berry et al. | 60/748 |
| 8,938,971 | B2 * | 1/2015 | Poyyapakkam et al. | 60/770 |
| 2002/0187448 | A1 | 12/2002 | Eroglu et al. | |
| 2003/0128364 | A1 | 7/2003 | Dickopf et al. | |
| 2003/0152459 | A1 | 8/2003 | Gliebe | |
| 2004/0050056 | A1 | 3/2004 | Pederson et al. | |
| 2004/0050061 | A1 | 3/2004 | Schmotolocha et al. | |
| 2004/0050063 | A1 | 3/2004 | Schmotolocha et al. | |
| 2005/0081508 | A1 | 4/2005 | Edelman et al. | |
| 2005/0178104 | A1 | 8/2005 | Schmotolocha et al. | |
| 2006/0230764 | A1 | 10/2006 | Schmotolocha et al. | |
| 2009/0081048 | A1 | 3/2009 | Beeck et al. | |
| 2009/0184181 | A1 * | 7/2009 | Berry | F23R 3/286 239/554 |
| 2009/0272117 | A1 * | 11/2009 | Wilbraham | 60/748 |
| 2009/0320485 | A1 | 12/2009 | Wilbraham | |
| 2012/0260622 | A1 * | 10/2012 | Poyyapakkam et al. | 60/39.465 |
| 2012/0285172 | A1 * | 11/2012 | Poyyapakkam et al. | 60/737 |
| 2012/0297777 | A1 * | 11/2012 | Poyyapakkam et al. | 60/737 |
| 2012/0297787 | A1 * | 11/2012 | Poyyapakkam et al. | 60/772 |
| 2014/0109588 | A1 * | 4/2014 | Ciani et al. | 60/776 |
| 2015/0167979 | A1 * | 6/2015 | Siden | F23R 3/16 60/772 |

FOREIGN PATENT DOCUMENTS

| | | | |
|---|---|---|---|
| EP | 1 257 809 | B1 | 10/2007 |
| EP | 1 894 616 | A1 | 3/2008 |
| GB | 2 437 977 | A | 11/2007 |
| JP | 62-275896 | A | 11/1987 |
| JP | 62-276202 | A | 12/1987 |
| JP | 09-324700 | A | 12/1997 |
| JP | 2001-507115 | A | 5/2001 |
| JP | 2003-090300 | A | 3/2003 |
| JP | 2004-263695 | A | 9/2004 |
| JP | 2006-336997 | A | 12/2006 |
| JP | 2009-174848 | A | 8/2009 |
| RU | 2 080 518 | C1 | 5/1997 |

OTHER PUBLICATIONS

Search Report issued on Oct. 12, 2011, by the Swiss Patent Office for Application No. 7942011.

Office Action (Notification of Reasons for Refusal) issued on Dec. 1, 2014, by the Japanese Patent Office in corresponding Japanese Patent Application No. 2012-109652 and an English translation of the Office Action. (10 pages).

* cited by examiner

SWIRLER HAVING VANES PROVIDED WITH AT LEAST TWO LOBES IN OPPOSITE TRANSVERSE DIRECTIONS WITH REFERENCE TO A VANE CENTRAL PLANE

RELATED APPLICATION(S)

This application claims priority under 35 U.S.C.§119 to European Patent Application No. 00794/11 filed in Switzerland on May 11, 2011, the entire content of which is hereby incorporated by reference in its entirety.

FIELD

The present disclosure relates to a lobed swirler, for example, to lobed swirlers for the introduction of at least one gaseous and/or liquid into a burner as well as a burner for a combustion chamber of a gas turbine including a lobed swirler.

BACKGROUND INFORMATION

Swirlers can be provided for mixing devices in various technical applications. Optimization of swirlers aims to reduce energy to obtain a specified degree of homogeneity. In continuous flow mixing, a pressure drop over a mixing device is a measure of energy. Further, the time and space to obtain the specified degree of homogeneity are useful parameters when evaluating mixing devices or mixing elements. Swirlers can be used for mixing of two continuous fluid streams.

High volume flows of gas can be, for example, mixed at an outlet of a turbofan engine, where hot exhaust gases of a core engine mix with relatively cold and slower bypass air. In order to reduce sound emissions caused by these different flows lobe mixers are disclosed in U.S. Pat. No. 4,401,269.

One application for mixing of continuous flow streams is the mixing of a fuel with an oxidizing fluid, for example air, in a burner for premixed combustion in a subsequent combustion chamber. In modern gas turbines, good mixing of fuel and combustion air is desirable for complete combustion with low emissions.

To achieve high efficiency, a high turbine inlet temperature is useful in standard gas turbines. As a result, there can arise high NOx emission levels and higher life cycle costs. These can be mitigated with a sequential combustion cycle, wherein the compressor delivers nearly double the pressure ratio of a known one. The main flow passes the first combustion chamber (e.g. using a burner of the general type as disclosed in EP 1 257 809 or as in U.S. Pat. No. 4,932,861, also called EV combustor, where the EV stands for EnVironmental), wherein a part of the fuel is combusted. After expanding at the high-pressure turbine stage, the remaining fuel is added and combusted (e.g. using a burner of the type as disclosed in U.S. Pat. No. 5,431,018 or U.S. Pat. No. 5,626,017 or in U.S. Patent Application Publication No. 2002/0187448, also called SEV combustor, where the S stands for sequential). Both combustors contain premixing burners, as low NOx emissions require high mixing quality of the fuel and the oxidizer.

Because the second combustor is fed by the expanded exhaust gas of the first combustor, the operating conditions can allow self-ignition (spontaneous ignition) of the fuel air mixture without additional energy being supplied to the mixture. To prevent ignition of the fuel air mixture in the mixing region, the residence time therein should not exceed the auto ignition delay time. This criterion can ensure flame-free zones inside the burner but can pose challenges in obtaining appropriate distribution of the fuel across the burner exit area.

SEV-burners can be designed for operation on natural gas and oil. Therefore, the momentum flux of the fuel can be adjusted relative to the momentum flux of the main flow so as to penetrate in to the vortices. This can be done using air from the last compressor stage (high-pressure carrier air). The high-pressure carrier air bypasses the high-pressure turbine. The subsequent mixing of the fuel and the oxidizer at the exit of the mixing zone is sufficient to allow low NOx emissions (mixing quality) and avoid flashback (residence time), which can be caused by auto ignition of the fuel air mixture in the mixing zone.

SUMMARY

A swirler is disclosed, comprising: an annular housing with limiting walls having an inlet area, and an outlet area in a first main flow direction prevailing in the swirler; at least two vanes, arranged in the annular housing, each having a streamlined cross-sectional profile, which extends with a longitudinal direction perpendicularly or at an inclination to the first main flow direction; wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes in opposite transverse directions.

A burner for a combustion chamber of a gas turbine is disclosed, comprising: a swirler including: an annular housing with limiting walls having an inlet area, and an outlet area in a first main flow direction prevailing in the swirler; and at least two vanes, arranged in the annular housing, each having a streamlined cross-sectional profile, which extends with a longitudinal direction perpendicularly or at an inclination to the first main flow direction; wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes in opposite transverse directions, wherein at least one of the vanes is arranged as at least one of: an injection device comprising at least one nozzle for introducing at least one fuel into the burner; at least one injection device with at least one nozzle for introducing at least one fuel into the burner provided upstream of the vanes; and at least one nozzle for introducing at least one fuel into the burner provided at the inner limiting wall and/or the outer limiting wall.

A method for operating a burner for a combustion chamber of a gas turbine is disclosed, the burner including a swirler having an annular housing with limiting walls having an inlet area, and an outlet area in a first main flow direction prevailing in the swirler; at least two vanes, arranged in the annular housing, each having a streamlined cross-sectional profile, which extends with a longitudinal direction perpendicularly or at an inclination to the first main flow direction, wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes in opposite transverse directions, wherein at least one of the vanes is arranged as at least one of an injection device comprising at least one nozzle for introducing at least one fuel into the burner, at least one injection device with at least one nozzle for introducing at least one fuel into the burner provided upstream of the vanes, and at least one nozzle for introducing at least one fuel into the burner provided at the inner limiting wall and/or the outer limiting wall, the method comprising: determining the number of fuel injection nozzles through which fuel is injected as a function of the total injected fuel flow.

BRIEF DESCRIPTION OF THE DRAWINGS

Exemplary embodiments of the disclosure are described in the following with reference to the drawings, which are for the purpose of illustrating the exemplary embodiments of the disclosure and not for the purpose of limiting the same. In the drawings.

DETAILED DESCRIPTION

Figure 1:
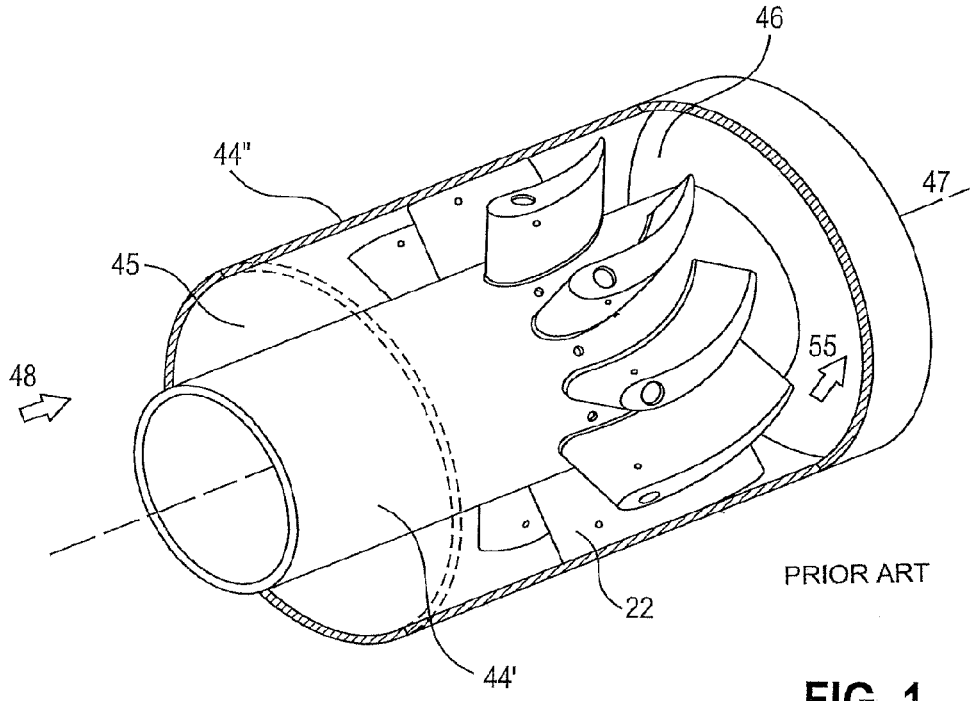
FIG. 1 shows a schematic perspective view of a known swirler with vanes having straight trailing edges.

Exemplary embodiments of the disclosure can provide a highly effective swirler with a low pressure drop. As an application of such a swirler a burner including such a swirler is disclosed.

A swirler, which can produce a mixture with a high homogeneity using only a minimum pressure drop, is disclosed. Further, a burner with such a swirler is disclosed. Such a burner can increase the gas turbine engine efficiency, to increase the fuel capability as well as to simplify the design.

The swirler according to an exemplary embodiment of the disclosure includes an annular housing with limiting walls having an inlet area, and an outlet area in a main flow direction. At least two vanes are arranged in the annular housing, each having a streamlined cross-sectional profile, which extends with a longitudinal direction perpendicularly, or at an inclination, to the main flow direction prevailing in the swirler. The leading edge area of each vane has a profile, which is oriented parallel to a main flow direction prevailing at the leading edge position, and wherein the profiles of the vanes turn from the main flow direction prevailing at the leading edge position to impose a swirl on the flow. The swirl can rotate around a center axis of the swirler. With reference to a central plane of the vanes, the trailing edges can be provided with at least two lobes in opposite transverse directions to improve the mixing at a low pressure drop.

As a result, a superimposed mixing device, which mixes due to the combined effect of the swirl and the vortices caused by the lobes, can be obtained. The swirl can lead to a mixing on a large scale and the vortices can mix on a small scale, resulting in an overall homogeneous mixing.

When applied to a burner, the lobed swirler can lead to good mixing at low pressure drop and also to a high recirculation flow in a subsequent combustor. A high recirculation flow can lead to better, more stable combustion. The flame stability can improve with the recirculation flow, i.e. combustion pulsations can be avoided or reduced with increasing recirculation flow.

Between 4 and 20 vanes can be used per swirler. In an exemplary embodiment according to the disclosure between 10 and 15 vanes can be used per swirler. To avoid Eigenfrequencies in flow downstream of the vanes, an odd number of vanes is suggested in an exemplary embodiment according to the disclosure.

The lobes alternatingly extend out of the central plane, i.e. in the transverse direction with respect to a central plane. The shape can be, for example, a sequence of semi-circles, sectors of circles, in a sinus or sinusoidal form, in the form of a combination of sectors of circles or sinusoidal curves and adjunct straight sections, where the straight sections can be asymptotic to the curves or sectors of circles. Triangular, rectangular or similar periodic shapes can be used. All lobes can be of substantially the same shape along the trailing edge. The lobes can be arranged adjacent to each other so that they form an interconnected trailing edge line. The lobe angles should be chosen in such a way that flow separation can be avoided. According to an exemplary embodiment according to the disclosure lobe angles ($\alpha_1$, $\alpha_2$) can be between 15° and 45°, (for example, between 25° and 35°) to avoid flow separation.

According to an exemplary embodiment of the disclosure, the layout of the lobes can provide a distribution of tangential velocity and axial velocity at the trailing edge of the blades that can lead to a sinusoidal radial distribution of the exit angle, where the exit angle is a normalized ratio of the tangential velocity (in radial direction) to the axial velocity. The distance in a radial direction between two maxima in the exit angle can be equal to the distance between two maxima in the deflection of lobes.

According to an exemplary embodiment of the disclosure, the trailing edge can be provided with at least 3, (for example, at least 4) lobes sequentially arranged one adjacent to the next along the trailing edge, and alternatingly lobing in the two opposite transverse directions.

In an exemplary embodiment of the disclosure the vane can include a substantially straight leading edge. The leading edge may however also be rounded, bent or slightly twisted.

According to an exemplary embodiment of the disclosure, the vane, in its upstream portion with respect to the main flow direction, has a maximum width. Downstream of this width W, the width (i.e. the distance between the lateral sidewalls defining the vane), substantially continuously diminishes towards the trailing edge (the trailing edge either forming a sharp edge or rounded edge). The height, defined as the distance in the transverse direction of the apexes of adjacent lobes, can be at least half of the maximum width. According to an exemplary embodiment of the disclosure, this height can be substantially the same as the maximum width of the vane. According to another exemplary embodiment of the disclosure, this height can be approximately twice the maximum width of the vane. The height can be at least as large as the maximum width, and can be not more than three times as large as the maximum width.

According to an exemplary embodiment of the disclosure, the swirler's vanes can include a substantially straight leading edge.

According to an exemplary embodiment, the transverse displacement of the vane forming the lobes can be in the downstream two thirds of the length l (measured along the main flow direction) of the vane. This means that the upstream portion of the vane can have a substantially symmetric shape with respect to the central plane. Downstream thereof the lobes can continuously and smoothly grow into each transverse direction forming a wavy shape of the sidewalls of the vane where the amplitude of this wavy shape is increasing the maximum value at the trailing edge.

For swirlers, in which the lobes are in phase, the average distance between the central planes of two vanes can be at least about 0.5 (±10%) times the height of the lobes, (for example, at least about 0.9 (±10%) times the height of the lobes) in order to optimize the flow pattern in the mixer.

According to an exemplary embodiment of the disclosure, the traverse deflection from the central plane of two adjacent vanes, which form the lobes can be inverted. For inverted lobes the average distance between the central planes of two vanes can be at least about 1.2 times (±10%) the height of the lobes (for example, about 1.5 (±10%) times the height of the lobes) in order to optimize the flow pattern in the mixer, and to allow mixing normal to the central planes of two vanes as well as in direction of the central planes of two neighboring vanes.

In an exemplary embodiment of the disclosure, the transition from a planar leading edge region to the deflections can be smooth with a surface curvature representing a function with a continuous first derivative.

According to an exemplary embodiment of the disclosure, the housing can be extended with a central axis aligned with the main flow direction. The resulting swirler has an inlet area and an outlet area, which are normal to the central axis to form an axial swirler with lobed vanes.

According to an exemplary embodiment of the disclosure, the lobe height and/or the periodicity can be a function of the radial distance of the lobe to the center axis of the swirler along the trailing edge of the vane. For example, the lobe height and/or the periodicity can be proportional to the radial distance of the lobe to the center axis of the swirler along the trailing edge of the vane.

Besides axial swirlers, radial swirlers with lobed vanes can be used. According to an exemplary embodiment of the disclosure, an annular housing can extend in a radial direction with a central axis normal to the main flow direction and the inlet area and the outlet area can be arranged concentric to form a radial swirler.

For use in applications with turbulent inflow to the swirler, at least two vanes can be provided with at least two lobes in opposite transverse directions at the leading edges of the vanes. In the flow direction, the additional lobes at the leading edge area can extend up to about the onset of the trailing edge lobes. They can have a flow conditioning effect on turbulent inflows and improve the mixing due to the downstream lobes.

In an exemplary embodiment of the disclosure, the traverse deflection from the central plane of two adjacent vanes, which form the lobes, can be in phase for a low pressure drop. For improved mixing, the traverse deflection from the central plane of two adjacent vanes, which form the lobes, can be out of phase. Phases can be inverted, i.e. the phase angle is 180°.

In an exemplary embodiment of the disclosure, to provide a burner with improved mixing, a burner includes a swirler configured as an injection device, wherein the swirler has at least one vane which is arranged in the burner with at least one nozzle for introducing the at least one fuel into the burner. The at least one vane has a streamlined cross-sectional profile h that extends with a longitudinal direction perpendicularly, or at an inclination, to a main flow direction prevailing in the swirler. According to an exemplary embodiment of the disclosure, such a vane is formed such that with reference to a central plane of the vane, the trailing edge can be provided with at least two lobes in opposite transverse directions.

For example, the trailing edge does not form a straight line but forms a wavy or sinusoidal line, where this line oscillates around the central plane. Exemplary embodiment of the disclosure involve injection of fuel from the lobed vane. The fuel can be injected at the trailing edge of the lobed injectors. The fuel injection can be along the axial direction, which can eliminate the need for high-pressure carrier air.

Exemplary embodiments of the disclosure allow fuel-air mixing with low momentum flux ratios being possible. An inline fuel injection system includes number of lobed vanes staggered to each other.

The burner can be used for fuel-air mixing as well as mixing of fuel with any kind of gas used in closed or semi-closed gas turbines or with combustion gases of a first combustion stage.

These burners can be used for gas turbines including one compressor, one combustor and one turbine as well as for gas turbines with one or multiple compressors, at least two combustors and at least two turbines. They can, for example, be used as premix burners in a gas turbine with one combustor or also be used in a reheat combustor for a secondary combustion chamber of a gas turbine with sequential combustion having a first and a second combustion chamber, with an injection device for the introduction of at least one gaseous and/or liquid fuel into the burner.

The burner can include one swirler or a plurality of swirlers. A burner with one swirler can have a circular cross section. A burner including a plurality of swirlers can have any cross-section but can be circular or rectangular. A plurality of burners can be arranged coaxially around the axis of a gas turbine. The burner cross section can be defined by a limiting wall, which, for example, forms a can like burner.

Exemplary embodiments of the disclosure can allow reduced pressure losses by an innovative injector design. The advantages can be as follows:

Increased Gas Turbine Efficiency

Lobes can be shaped to produce appropriate flow structures. Intense shear of the vortices can help in rapid mixing and avoidance of low velocity pockets. An aerodynamically favored injection and mixing system can reduce the pressure drop even further. Due to only having one device (injector) rather than the separate elements i) large-scale mixing device at the entrance of the burner, ii) vortex generators on the injector, and iii) injector pressure can be saved. The savings can be utilized in order to increase the main flow velocity, which can be beneficial if it comes to fuel air mixtures with high reactivity or can be utilized to increase the gas turbine performance.

The fuel can be injected in-line right at the location where the vortices are generated. The design of the cooling air passage can be simplified, as the fuel does not require momentum from high-pressure carrier air.

Exemplary embodiments of the disclosure can merge the vortex generation aspect and the fuel injection device as separate elements (separate structural vortex generator element upstream of separate fuel injection device) into one single combined vortex generation and fuel injection device. By doing this, mixing of fuels with oxidation air and vortex generation can take place in relatively close spatial vicinity and relatively efficiently, such that rapid mixing is possible and the length of the mixing zone can be reduced. It can be possible in some cases, by corresponding design and orientation of the body in the oxidizing air path, to omit the flow conditioning elements (flow straightener, guide vanes) as the body may also take over the flow conditioning. This can be possible without severe pressure drop along the injection device such that the overall efficiency of the process can be maintained or improved.

For gas turbine applications, the vane can have a height H along its longitudinal axis (perpendicular to the main flow) in the range of about 20-200 mm. In particular under the circumstances, the lobe periodicity ("wavelength") $\lambda$ can be in the range of about 10-100 mm (for example, in the range of 20-60 mm). This means that along the trailing edge of a vane there can be located, for example, six alternating lobes, three in each transverse direction.

According to an exemplary embodiment of the disclosure, at least two, (for example, at least three, four, five or more) fuel nozzles can be located at the trailing edge and distributed (for example, in equidistant manner) along the trailing edge.

According to an exemplary embodiment of the disclosure, the fuel nozzles can be located substantially on the central plane of the vane (not in the lobed portions of the trailing edge). In this case, a fuel nozzle can be located at each position or every second position along the trailing edge, where the lobed trailing edge crosses the central plane.

According to an exemplary embodiment of the disclosure, the fuel nozzles can be located substantially at the apexes of lobes, wherein a fuel nozzle can be located at each apex or every second apex along the trailing edge.

According to an exemplary embodiment of the disclosure, a burner, at least one injection device, with at least one nozzle for introducing at least one fuel into the burner upstream of the vanes and/or at least one nozzle for introducing at least one fuel into the burner, is provided at the inner limiting wall and/or the outer limiting wall of the burner.

At least the nozzle injects fuel (for example, liquid or gas) and/or carrier gas parallel to the main flow direction. At least one nozzle can also inject fuel and/or carrier gas at an inclination angle of for example, not more than about 30° with respect to the main flow direction.

The vane can extend across the entire flow cross section between opposite walls of the burner.

According to an exemplary embodiment of the disclosure, the vane can be provided with cooling elements, wherein these cooling elements can be internal circulation of a cooling medium along the sidewalls of the vane (i.e. by providing a double wall structure) and/or by film cooling holes, for example, located near the trailing edge. The cooling elements can be fed with air from the carrier gas feed also used for the fuel injection.

A plurality of separate outlet orifices of a plurality of nozzles can be arranged next to one another and arranged at the trailing edge.

At least one slit-shaped outlet orifice can be, in the sense of a nozzle, arranged at the trailing edge. A split-shaped or elongated slot nozzle can be arranged to extend along the trailing edge of the vane.

The nozzles can include multiple outlet orifices for different fuel types and carrier air. In an exemplary embodiment of the disclosure, a first nozzle for injection of liquid fuel or gas fuel, and a second nozzle for injection of carrier air, which encloses the first nozzle, can be arranged at the trailing edge.

In an exemplary embodiment of the disclosure, a first nozzle for injection of liquid fuel, a second nozzle for injection of a gaseous fuel, which encloses the first nozzle, and a third nozzle for injection of carrier air, which encloses the first nozzle, and the second nozzle, can be arranged at the trailing edge.

An exemplary embodiment of the disclosure relates to a method for operation of a burner including a swirler. Depending on the operating conditions, and load point of a gas turbine, the fuel flow injected through a burner can vary in a wide range. A simple operation where the flow is equally distributed to all burner nozzles and the flow through each nozzle is proportional to the total flow, can lead to relatively small flow velocities at individual nozzles impairing the injection quality and penetration depth of the fuel into the air flow.

According to an exemplary embodiment of the operating method, the number of fuel injection nozzles through which fuel is injected can be determined as a function of the total injected fuel flow in order to assure a minimum flow in the operative nozzles.

In an exemplary embodiment, the fuel can be injected through every second fuel nozzle of a vane at low fuel flow rates. Alternatively, the fuel can be injected only through the fuel nozzles of every second or third vane of the burner. The combination of both methods to reduce fuel injection can be used. For low fuel mass flows, the fuel can be injected through every second or third fuel nozzle of a vane and only through the fuel nozzles of every second or third vane of the burner is proposed. At an increased mass flow, the number of vanes used for fuel injection and then the number of nozzles used for fuel injection per vane can be increased. Alternatively, at an increased mass flow, the number of nozzles used for fuel injection per vane can be increased and then the number of vanes used for fuel injection can be increased. Activation and deactivation of nozzles can be, for example, determined based on corresponding threshold fuel flows.

Exemplary embodiments of the disclosure relate to the use of a burner, as defined above, for combustion under relatively high reactivity conditions, for example, for the combustion at high burner inlet temperatures and/or for the combustion of MBtu fuel, normally with a calorific value of 5000-20,000 kJ/kg, (for example, 7000-17,000 kJ/kg, and 10,000-15,000 kJ/kg), and such a fuel including hydrogen gas.

FIG. 1 shows in a schematic perspective view of a known swirler 43. The swirler 43 includes an annular housing with an inner limiting wall 44', an outer limiting wall 44", an inlet area 45, and an outlet area 46. Vanes 22 are arranged between the inner limiting wall 44' and outer limiting wall 44". The leading edge area of each vane 22 has a profile, which is oriented parallel to the inlet flow direction 48. In the example shown, the inflow is coaxial to the longitudinal axis 47 of the swirler 43. The profiles of the vanes 22 turn from the main flow direction 48 to impose a swirl on the flow, and resulting in an outlet flow direction 55, which has an angle relative to the inlet flow direction 48. The main flow is coaxial to the annular swirler. The outlet flow rotates around the axis of the swirler.

Figure 2:
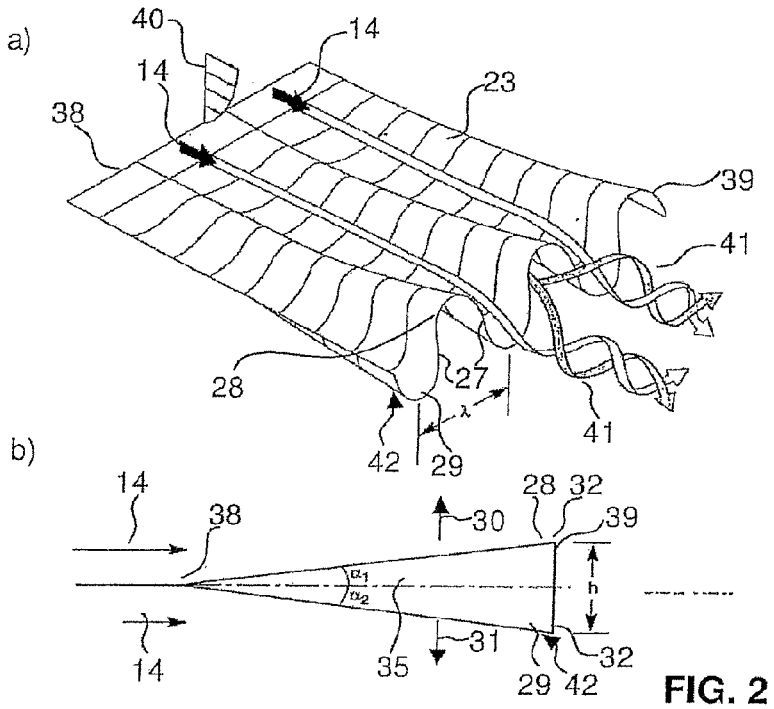
FIG. 2 shows in a) a schematic perspective view of a lobed vane according to an exemplary embodiment of the disclosure and the flow paths generated on both sides and at the trailing edge thereof, and in b) a side elevation view thereof.

The lobed mixing according to an exemplary embodiment of the disclosure is described with reference to FIG. 2. FIG. 2 shows the flow conditions along a single vane. The central plane 35 is arranged substantially parallel to a flow direction 14 of an airflow, which has a straight leading edge 38 and a lobed trailing edge 39. The airflow 14 at the leading edge in a situation like that develops a flow profile as indicated schematically in the upper view with the arrows 14.

The lobed structure 42 at the trailing edge 39 is progressively developing downstream of the leading edge 38 to a wavy shape with lobes going into a first direction 30, which is transverse to the central plane 35. The lobe extending in the first direction 30 is designated with the reference numeral 28. Lobes extending into a second transverse direction 31, in FIG. 1*a* in a downward direction, are designated with reference numeral 29. The lobes alternate in the two directions and wherever the lobes, or the line/plane forming the trailing edge, pass the central plane 35 there is a turning point 27.

As can be seen from the arrows indicated in FIG. 2*a*, the airflow flowing in the channel-like structures on the upper face and the airflows in the channels on the lower face intermingle and start to generate vortexes downstream of the trailing edge 39 leading to an intensive mixing as indicated with reference numeral 41. These vortices 41 are useable for the injection of fuels/air as will be discussed further below.

The lobed structure 42 can be defined by the following parameters:

The periodicity $\lambda$ gives the width of one period of lobes in a direction perpendicular to the main flow direction 14;

The height h is the distance in a direction perpendicular to the main flow direction 14, so along the directions 30 and 31, between adjacent apexes of adjacent lobes as defined in FIG. 2*b;*

The first lobe angle $\alpha 1$ (also called elevation angle) which defines the displacement into the first direction of the lobe 28; and The second lobe angle $\alpha 2$ (also called elevation angle), which defines the displacement of lobe 29 in the direction 31. $\alpha 1$ can be substantially identical to $\alpha 2$.

FIG. 3 shows in a) and b) a swirler 43 with a plurality of vanes 22 from a downstream end of the swirler. The lobes on neighboring vanes 22 shown in a) can be arranged in phase with each other, i.e. the lobes have the same periodicity. Thus, lobes 22 of neighboring vanes 22 cross their respective centerline at the same position in longitudinal direction, and at the same position in longitudinal direction the deflection of each body has the same absolute value.

The lobes on neighboring vanes 22 shown in b) are arranged out of phase with each other, in particular the phases are shifted by 180°, i.e. lobes of both vanes 22 cross the center line at the same position in longitudinal direction, and at the same position in longitudinal direction, the deflection of each body has the same absolute value but is in an opposite direction.

Lobes, which are arranged out of phase, can lead to improved mixing.

Figure 3A:
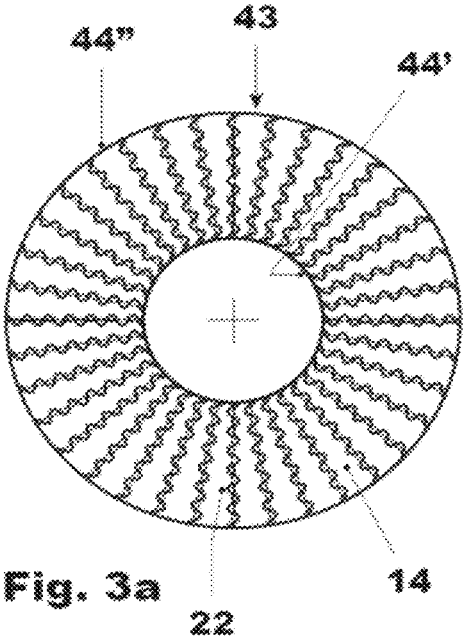
FIG. 3 shows in a) a swirler according to an exemplary embodiment of the disclosure, with vanes from a downstream end with lobes on neighboring vanes arranged in phase with each other, and in b) out of phase and further shows in c) an example of an annular combustor with burners including one swirler per burner as well as in d) an example of an annular combustor with a burners including five swirlers per burner.
Figure 3B:
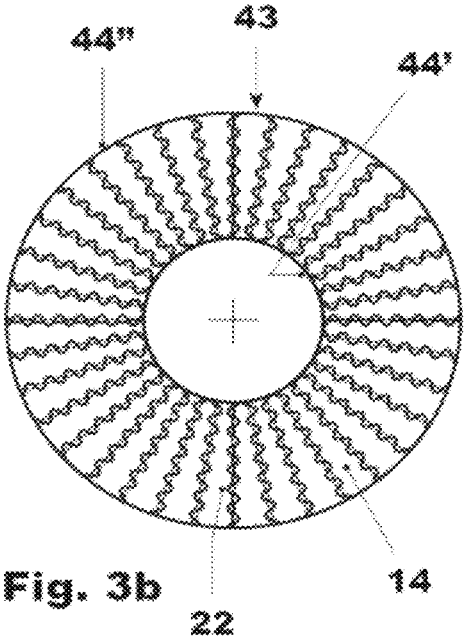
Figure 3C:
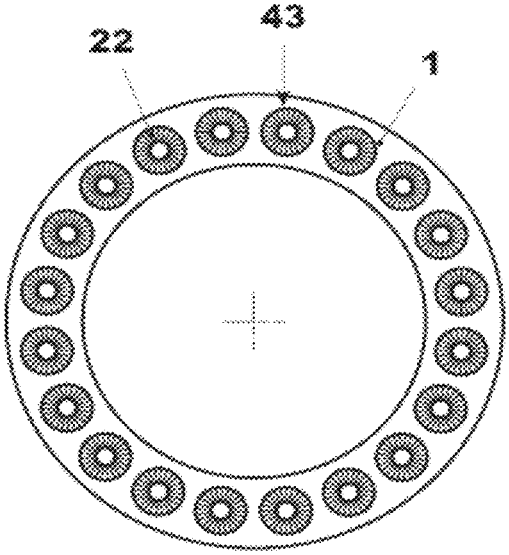
Figure 3D:
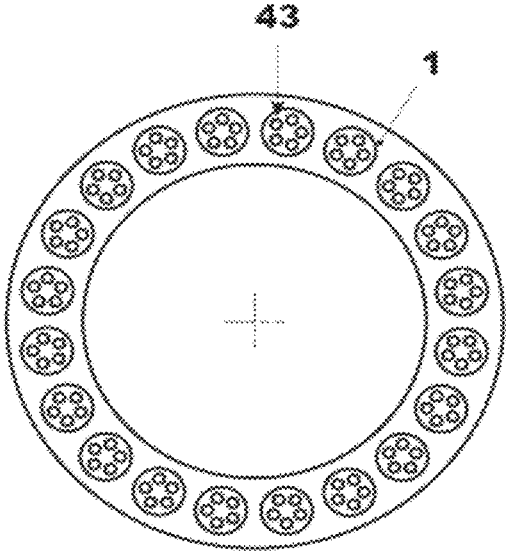

FIGS. 3*c*) and 3*d*) show exemplary embodiments of annular combustors with burners 1 including swirlers 43 with lobed trailing edges on their vanes 22 from a downstream end. The burners 43 can be distributed equally spaced on circle around the center axis of a gas turbine and discharge the combustible mixture of fuel and gas into an annular combustor. In the example shown in FIG. 3*c*) each burner 1 includes one swirler 43. In the example shown in FIG. 3*d*) five swirlers 43 can be arranged in a circular pattern in each burner 1.

The burners of FIGS. 3*c*) and 3*d*) can also be used in combination with a plurality of can combustors instead of in one annular combustor.

Figure 4A:
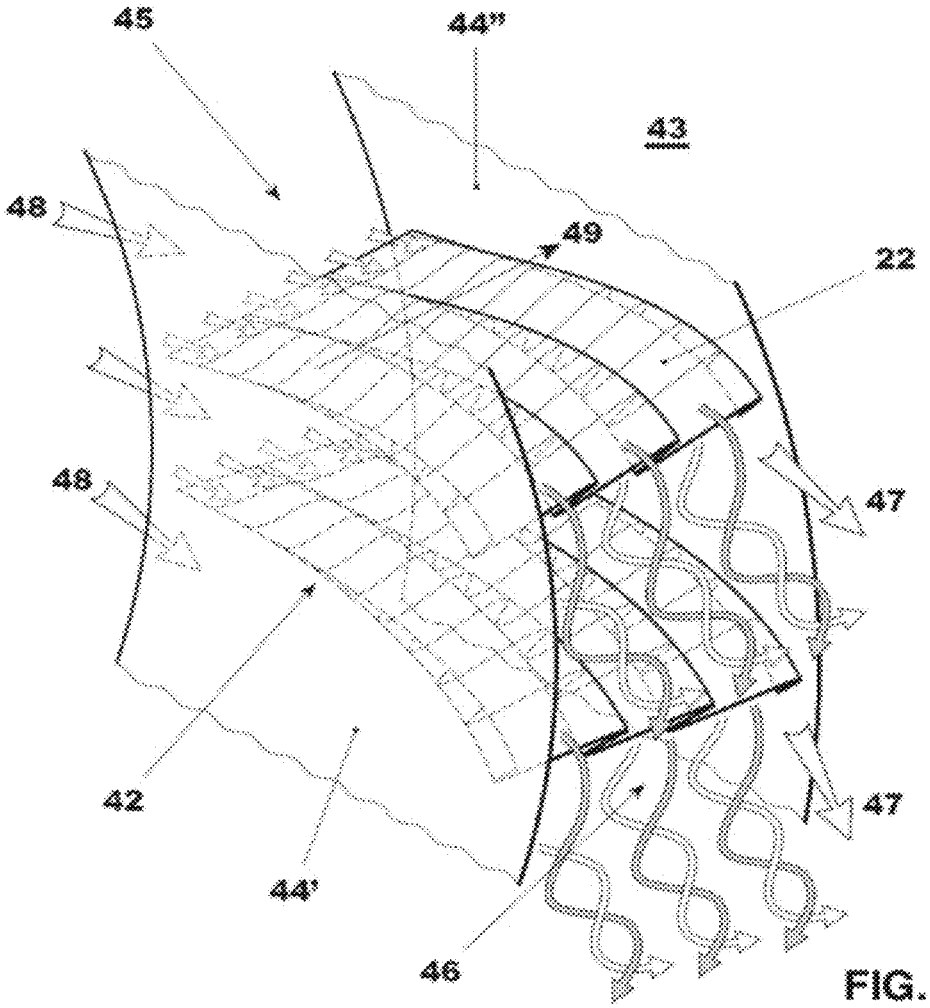
FIG. 4 shows in a) a schematic perspective view of section of a swirler according to an exemplary embodiment of the disclosure including vanes where lobes on neighboring vanes are arranged in phase and in b) a section of a flat projection of the swirler.
Figure 4B:
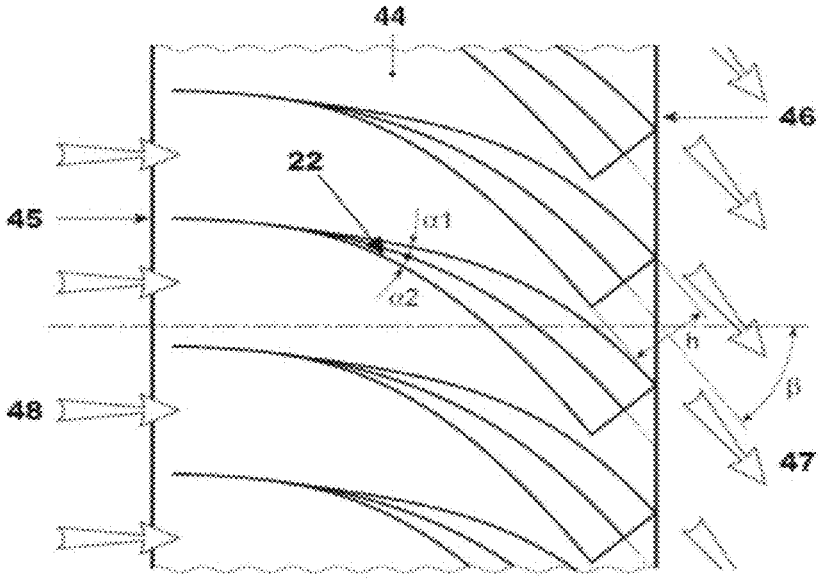

A perspective view of a section of a swirler 43 of the kind used in FIG. 3*a* is shown in FIG. 4*a*. FIG. 4*a* shows a perspective view of a section of a swirler 43 including two vanes 22 with lobes on the trailing edges, which are arranged between an inner limiting wall 44', and an outer limiting wall 44", which form an annular flow path with an inlet area 45 and an outlet area 46. The lobes on the vanes 22 are arranged in phase.

The vanes 22 can be configured to redirect the main flow, which enters the swirler 43 in the inlet flow direction 48 coaxially to the annular flow path to a flow direction, to impose a swirl on the flow, and resulting in an outlet flow direction 55, which has an angle relative to the inlet flow direction 48 and rotates around the axis of the swirler 43.

The flat projection of the swirler 43 with lobes on the trailing edges of the vanes 22 is shown in FIG. 3*b*. It shows the height h of the vanes 22 as the distance in a direction perpendicular to the main flow direction between adjacent apexes of adjacent lobes, the first lobe angle $\alpha 1$ which defines the displacement into the first direction of the lobe 28, and the second lobe angle $\alpha 2$, which defines the displacement of lobe 29 in the direction 31. The lobe angles $\alpha_1$ and $\alpha_2$ are relative to a tangential to the centerline of the lobe 22. $\alpha 1$ can be substantively identical to $\alpha_2$. The lobes either extend with a constant lobe angle in axial direction or start practically parallel to the main flow direction and the lobe angle is gradually increasing in flow direction.

Further, FIG. 3*b* shows the outlet angle $\beta$, by which the main flow is turned in the swirler 43 to impose a swirl on the flow.

Figure 5:
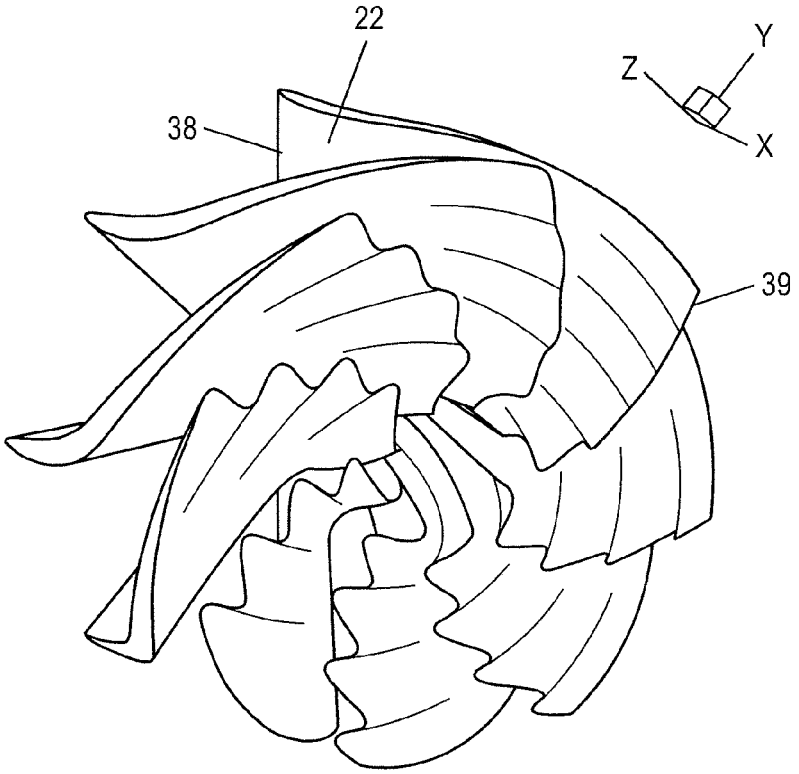
FIG. 5 shows a schematic perspective view of a swirler according to an exemplary embodiment of the disclosure with twisted vanes and lobes at the trailing edge.

FIG. 5 shows a schematic perspective view of the vanes 22 in a swirler. The sidewalls and inlet are not shown. In this example the vanes 22 have a straight leading edge 38, are twisted, and lobes are arranged in phase at the trailing edges 39.

Figure 6:
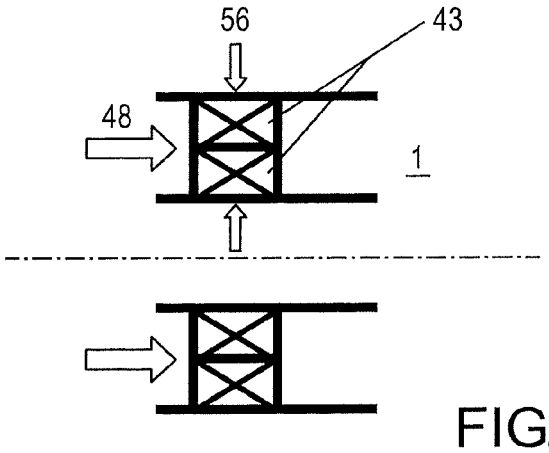
FIG. 6 shows a schematic side view of a burner according to an exemplary embodiment of the disclosure with two concentrically arranged swirlers.

FIG. 6 shows a schematic side view of a burner 1 with two concentrically arranged swirlers 43. Air 48 and fuel 56 can be supplied to the burner 1. The two swirlers 43 include vanes, which turn in opposite direction thereby imposing counter-rotating swirls on the air and fuel mixture leaving the swirlers 43, thus improving the mixing in the burner. The lobes of vanes 22 of the inner and outer swirler 43 can be of different form, size and orientation. For example, the vanes 22 on the inner swirler 43 can have lobes on neighboring vanes 22, which are arranged out of phase for improved mixing and to compensate for a smaller velocity component in circumferential direction while the vanes 22 on the outer swirler 43 can have lobes on neighboring vanes 22, which are arranged in phase to reduce the pressure trop or to allow a high axial velocity.

Figure 7C:
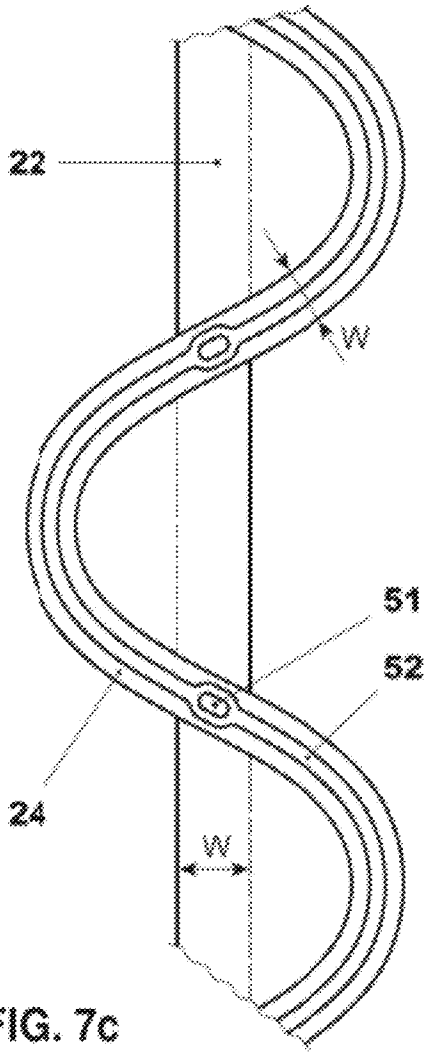
FIG. 7 shows views against the main flow onto the trailing edge of lobed vanes with different nozzle arrangements according to an exemplary embodiment of the disclosure.
Figure 7B:
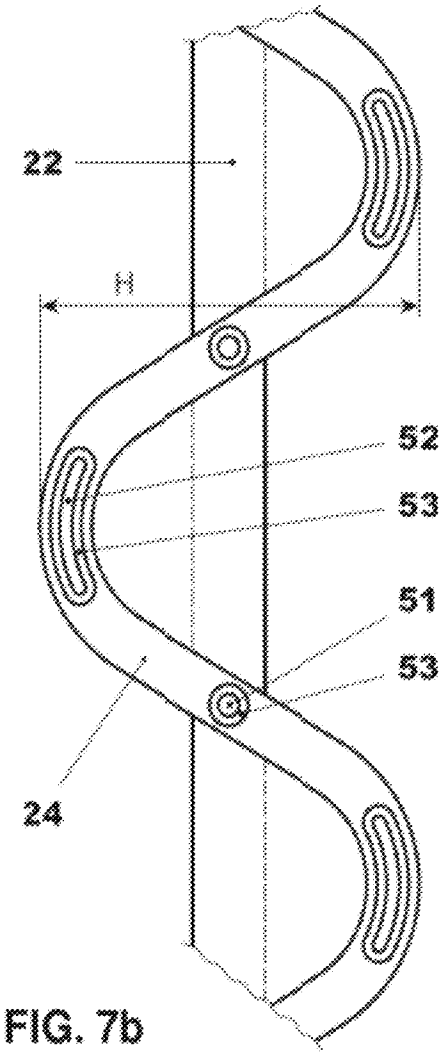
Figure 7A:
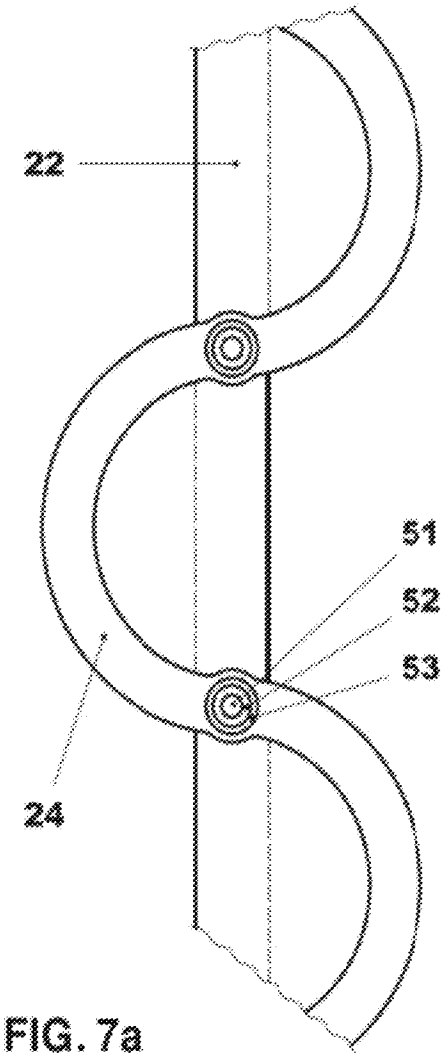

FIG. 7 shows views against the main flow onto the trailing edge of lobed vanes 22 with different nozzle arrangements according to an exemplary embodiment of the disclosure. FIG. 7*a* shows an arrangement where first nozzles 51 for injection of liquid fuel, are enclosed by second nozzles 52 for injection of a gaseous fuel, which themselves are encloses by third nozzles 53 for injection of carrier air. The nozzles 51, 52, 53 can be arranged concentrically at the trailing edge. Each nozzle arrangement is located where the lobed trailing edge crosses the center plane 35.

FIG. 7*b* shows an arrangement where second nozzles 52 for fuel gas injection are configured as a slit-like nozzle extending along the trailing edge, each at each apex section of the lobes. Additionally first nozzles 51 for liquid fuel injection are arranged at each location where the lobed trailing edge crosses the center plane 35. All the first and second nozzles 51, 52 are enclosed by third nozzles 53 for the injection of carrier air.

FIG. 7*c* shows an arrangement where a second nozzle 52 for fuel gas injection is configured as one slit-like nozzle extending along at least one lobe along the trailing edge. For liquid fuel injection additional first nozzles 51 in the form of orifices can be arranged in the second nozzles 52.

A burner with lobed swirlers can operate with increased fuel flexibility without suffering on high NOx emissions or flashback.

Some advantages can be summarized as follows:

Higher burner velocities to accommodate highly reactive fuels;

Lower burner pressure drop for similar mixing levels achieved with current designs; and The mixing of the fuel and the oxidizer at the exit of the mixing zone can be sufficient to allow low NOx emissions (mixing quality) and avoid flashback (residence time), which may be caused by auto ignition of the fuel air mixture in the mixing zone.

An exemplary embodiment the disclosure relates to burning of fuel air mixtures with a low ignition delay time. This can be achieved by an integrated approach, which allows higher velocities of the main flow and in turn, a lower residence time of the fuel air mixture in the mixing zone. The challenge regarding the fuel injection is twofold with respect to the use of hydrogen rich fuels and fuel air mixtures with high temperatures:

Hydrogen rich fuels can change the penetration behavior of the fuel jets. The penetration can be determined by the cross section areas of the burner and the fuel injection holes, respectively;

The second issue is that depending on the type of fuel or the temperature of the fuel air mixture, the reactivity, which can be defined as tign,ref/tign, i.e. as the ratio of the ignition time of reference natural gas to the actual ignition time of the fuel air mixture can change.

Conditions which exemplary embodiments of the disclosure can address are those where the reactivity as defined above is above 1 and the flames are auto igniting. The disclosure is however not limited to these conditions.

For each temperature and mixture composition the laminar flame speed and the ignition delay time can change. As a result, hardware configurations should be provided offering a suitable operation window. For each hardware configuration, the upper limit regarding the fuel air reactivity is given by the flashback margin.

In any burner the flashback can be increased, as the residence time in the mixing zone exceeds the ignition delay time of the fuel air. Mitigation can be achieved in several different ways:

The inclination angle of the fuel can be adjusted to decrease the residence time of the fuel. Herein, various possibilities regarding the design may be considered, e.g. inline fuel injection, i.e. essentially parallel to the oxidizing airflow, a conical lance shape or a horny lance design.

The reactivity can be slowed down by diluting the fuel air mixture with nitrogen or steam, respectively.

De-rating of the first stage can lead to less aggressive inlet conditions for the second combustor in a gas turbine with sequential combustion in case of highly reactive fuels. In turn, the efficiency of the overall gas turbine can decrease.

The length of the mixing zone can be kept constant, if in turn the main flow velocity is increased. However, then normally a penalty on the pressure drop must be taken.

By implementing more rapid mixing of the fuel and the oxidizer, the length of the mixing zone can be reduced while maintaining the main flow velocity.

Exemplary embodiments of this disclosure can evolve an improved burner configuration, wherein the latter two points are addressed, which however can be combined also with the upper three points.

In order to allow capability for highly reactive fuels, the injector can be designed to perform flow conditioning (at least partial), injection and mixing simultaneously. As a result, the injector can save burner pressure loss, which is currently utilized in the various devices along the flow path. If the combination of flow conditioning device, vortex generator and injector is replaced by the exemplary embodiments of the disclosure, the velocity of the main flow can be increased in order to achieve a short residence time of the fuel air mixture in the mixing zone.

One measure to judge the performance of a burner is the relative recirculation flow $r_r$ in a combustion chamber, where $r_r$ is defined as the ratio of recirculated flow to swirl flow. A high recirculation rate can lead to better combustion. The flame stability can improve with the recirculation rate, i.e. combustion pulsations can be avoided or reduced with increasing recirculation rate. However, to achieve a high relative recirculation flow $r_r$, a high swirl number $s_n$, is desirable, where $s_n$ is defined as the ratio of swirl flow to total mass flow through the burner 1. Because a swirl flow can only be imposed with a pressure drop, the swirl number $s_n$ should be kept low for an optimized performance, i.e. power and efficiency of the gas turbine.

Figure 8:
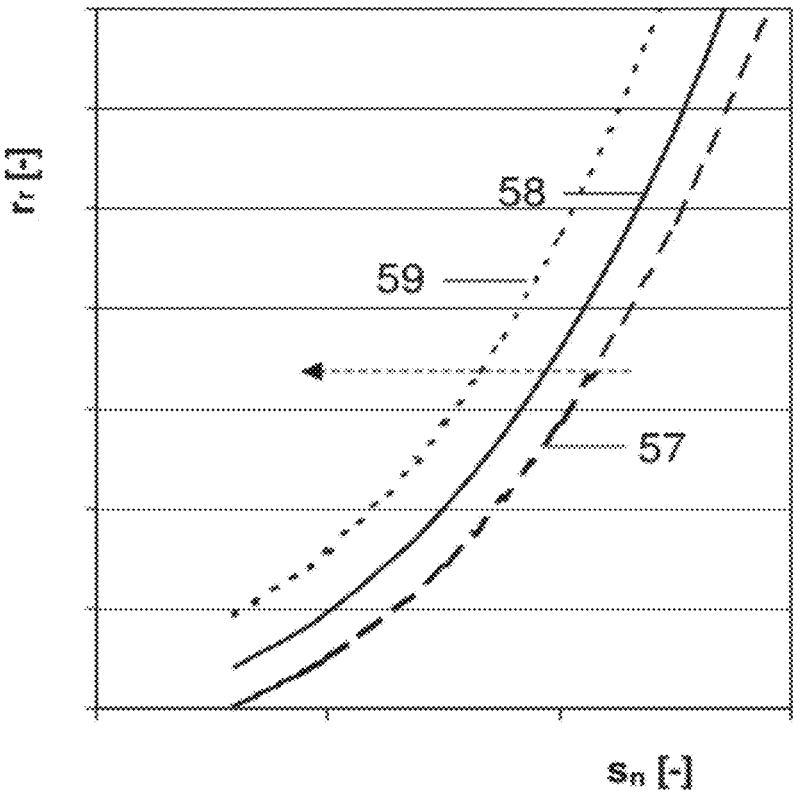
FIG. 8 schematically shows the relative recirculation flow as a function of the swirl number for different swirler types.

FIG. 8 schematically shows the recirculation rate $r_r$ as a function of the swirl number $s_n$. The recirculation rate 57 is shown for a swirler 43 with flat vanes 22, the recirculation rate 58 is shown for a swirler 43 with curved or twisted vanes 22, and the recirculation rate 59 is shown for a swirler 43 with curved or twisted vanes 22 and lobes 42. FIG. 8 indicates that a higher relative recirculation flow $r_r$ can be achieved at a given swirl number $s_n$ swirl therefore improving the combustion without increasing the burner and combustor pressure drop. Thus the lobed swirler allows combustion at high hot gas temperatures with low emissions.

Several embodiments to the lobed fuel injection system are described below:

Exemplary Embodiment 1

Staggering of lobes to eliminate vortex-vortex interactions. The vortex-vortex interactions can result in not effectively mixing the fuel air streams.

Exemplary Embodiment 2

Careful placement and location of fuel injection on the lobes: Fuel jets can be placed in the areas of high shear regions in order to utilize the turbulent dissipation for mixing.

Exemplary Embodiment 3

Inclined fuel injection in the lobes: This can allow fuel to be injected in to the vortex cores.

Exemplary Embodiment 4

Number of vanes and/or lobes inside the burner: The vanes and/or lobes can be varied to decide on the strength of the vortices.

Exemplary Embodiment 5

Fuel staging in the lobed fuel injectors to control emissions and pulsations.

Some advantages of lobed injectors when compared to existing concepts can be summarized as follows:

Better streamlining of hot gas flows to produce strong vortices for rapid mixing and low-pressure drops.

The high speed shearing of fuel mixture can be utilized to control combustor pulsations and flame characteristics.

The lobed flute injector is flexible, offering several design variations.

Rapid shear of fuel and air due to lobed structures can result in enhanced mixing delivered with shorter burner mixing lengths.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 burner
2 mixing space, mixing zone
3 burner wall
4 combustion space
5 outlet side, burner exit
6 inlet side
7 injection device, fuel lance
8 main flow from high-pressure turbine
9 flow conditioning, turbine outlet guide vanes
10 vortex generators
11 fuel mass fraction contour at burner exit 5
12 combustion chamber wall
13 transition between 3 and 12
14 flow of oxidizing medium
15 fuel nozzle
16 foot of 7
17 shaft of 7
18 converging portion of 3
19 reduced burner cross-sectional area
20 reduction in cross section
21 entrance section of 3
22 vane
23 lobed blade
24 trailing edge of 22, 23
25 leading edge of 22, 23
26 injection direction
27 turning point
28 lobe in first direction 30
29 lobe in second direction 31
30 first transverse direction
31 second transverse direction
32 apex of 28,29
33 lateral surface of 22
34 ejection direction of fuel/carrier gas mixture
35 central plane of 22/23
38 leading edge of 24
39 trailing edge of 23
40 flow profile
41 vortex
42 lobes
43 swirler
44 limiting walls
44' inner limiting wall
44" outer limiting wall
45 inlet area
46 outlet area
47 longitudinal axis of 43
48 inlet flow direction
49 longitudinal axis of 22
50 central element
51 first nozzle
52 second nozzle
53 third nozzle
54 slot nozzle
55 outlet flow direction
56 fuel
57 function for flat vanes
58 function for curved vanes
59 function for lobed vanes
$\lambda$ periodicity of 42
h height of 42
$\alpha_1$ first lobe angle
$\alpha_2$ second lobe angle
$\beta$ inlet angle
l length of 22
H height of 22
w width at trailing edge
W maximum width of 22
$r_r$ recirculation rate
$s_n$ swirl number

What is claimed is:

1. A swirler, comprising:

an annular housing with limiting walls having an inlet area, and an outlet area in a first main flow direction prevailing in the swirler;

at least two vanes, arranged in the annular housing, each vane having a streamlined cross-sectional profile, which extends with a longitudinal direction perpendicularly or at an inclination to the first main flow direction; wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes alternatingly extending out of the central plane in opposite transverse directions;

wherein a traverse deflection from the central plane of two adjacent vanes, which form the lobes, are inverted, and a transition from a planar leading edge region to the deflections is smooth with a surface curvature representing a function with a continuous first derivative;

wherein a transverse displacement of each vane forming the lobes, is at most, in the downstream two thirds of a length of the vane and the transverse displacement of each vane, which forms the lobes, has a sinusoidal form or a semi-circular form or a triangular form or a rectangular form.

2. A swirler, comprising:

an annular housing with limiting walls having an inlet area, and an outlet area in a first main flow direction prevailing in the swirler;

at least two vanes, arranged in the annular housing, each vane having a streamlined cross-sectional profile, which extends with a longitudinal direction perpendicularly or at an inclination to the first main flow direction; wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes alternatingly extending out of the central plane in opposite transverse directions;

wherein a traverse deflection from the central plane of two adjacent vanes, which form the lobes, are inverted, and a transition from a planar leading edge region to the deflections is smooth with a surface curvature representing a function with a continuous first derivative, wherein the annular housing extends with a central axis aligned with the first main flow direction having the inlet area and the outlet area normal to the central axis to form an axial swirler.

3. A swirler, comprising:

an annular housing with limiting walls having an inlet area, and an outlet area in a first main flow direction prevailing in the swirler;

at least two vanes, arranged in the annular housing, each vane having a streamlined cross-sectional profile, which extends with a longitudinal direction perpendicularly or at an inclination to the first main flow direction; wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes alternatingly extending out of the central plane in opposite transverse directions;

wherein a traverse deflection from the central plane of two adjacent vanes, which form the lobes, are inverted, and a transition from a planar leading edge region to the deflections is smooth with a surface curvature representing a function with a continuous first derivative;

wherein a lobe height and/or the periodicity ($\lambda$) is a function of a radial distance of the lobe to a center axis of the swirler along the trailing edge of each vane and/or proportional to the radial distance of the lobe to the center axis of the swirler along the trailing edge of each vane.

4. A swirler, comprising:

an annular housing with limiting walls having an inlet area, and an outlet area in a first main flow direction prevailing in the swirler;

at least two vanes, arranged in the annular housing, each vane having a streamlined cross-sectional profile, which extends with a longitudinal direction perpendicularly or at an inclination to the first main flow direction; wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes alternatingly extending out of the central plane in opposite transverse directions;

wherein a traverse deflection from the central plane of two adjacent vanes, which form the lobes, are inverted, and a transition from a planar leading edge region to the deflections is smooth with a surface curvature representing a function with a continuous first derivative;

wherein the inlet area and the outlet area are concentric and the annular housing extends with a central axis normal to the first main flow direction to form a radial swirler.

5. A method for operating a burner for a combustion chamber of a gas turbine, the burner including a swirler having an annular housing with limiting walls having an inlet area, and an outlet area in a first main flow direction prevailing in the swirler; at least two vanes, arranged in the annular housing, each vane having a streamlined cross-sectional profile, which extends with a longitudinal direction perpendicularly or at an inclination to the first main flow direction, wherein a leading edge area of each vane has a profile, which is oriented parallel to a second main flow direction prevailing at a leading edge position, and wherein the profiles of the vanes turn from the second main flow direction prevailing at the leading edge position to impose a swirl on the flow, wherein, with reference to a central plane of the vanes, trailing edges are provided with at least two lobes alternatingly extending out of the central plane in opposite transverse directions, wherein at least one of the vanes is arranged as at least one of an injection device comprising at least one nozzle for introducing at least one fuel into the burner, at least one injection device with at least one nozzle for introducing at least one fuel into the burner provided upstream of the vanes, and at least one nozzle for introducing at least one fuel into the burner provided at the inner limiting wall and/or the outer limiting wall, the method comprising:

determining the number of fuel injection nozzles through which fuel is injected as a function of the total injected fuel flow wherein the fuel nozzles are circular and/or are elongated slot nozzles extending along the trailing edge of the vane and/or comprise a first nozzle for injection of liquid fuel, and/or a second nozzle for injection of a gaseous fuel and a third nozzle for injection of carrier air, which encloses the first nozzle and/or the second nozzle;

below threshold fuel flows, fuel is only injected through every second or third fuel nozzle of a vane and/or only injected through the fuel nozzles of every second or third vane of the burner;

injecting high reactivity fuel through the trailing edge of the vanes; and injecting low reactivity fuel through an injection device for introducing at least one fuel into the burner, which is provided upstream of the vanes and/or at least one nozzle for introducing at least one fuel into the burner, which is provided at the inner limiting wall and/or the outer limiting wall and/or through an injection device for introducing at least one fuel into the burner, which is provided at the surfaces of the vanes upstream of the trailing edge.

* * * * *